United States Patent [19]

Warthen

[11] 4,030,743

[45] June 21, 1977

[54] SYNTHETIC YARN DEVICE

[75] Inventor: William P. Warthen, Spartanburg, S.C.

[73] Assignee: Milliken Research Corporation, Spartanburg, S.C.

[22] Filed: May 24, 1976

[21] Appl. No.: 689,162

[52] U.S. Cl. ..... 289/18; 28/209; 83/15; 156/515

[51] Int. Cl.[2] ..... D03J 3/00; B26F 3/08; B32B 31/18

[58] Field of Search ..... 289/1.2, 1.5, 17, 18; 28/47; 156/433, 502, 515; 83/15, 16

[56] References Cited

UNITED STATES PATENTS

| | | | |
|---|---|---|---|
| 2,514,197 | 7/1950 | Groten et al. | 156/433 |
| 3,358,324 | 12/1967 | Morin | 156/433 |

FOREIGN PATENTS OR APPLICATIONS

| | | | |
|---|---|---|---|
| 4,723,343 | 6/1972 | Japan | 289/18 |

*Primary Examiner*—Louis K. Rimrodt
*Attorney, Agent, or Firm*—H. William Petry; Earle R. Marden

[57] ABSTRACT

Apparatus and method to prevent the slippage of a knot in tied synthetic yarn so that the tied yarns will not separate in the textile operation. The knotted yarns to be locked together actuate the switch to apply heat to the yarns to lock the knot in the yarns and sever the tails of the tied yarns.

2 Claims, 6 Drawing Figures

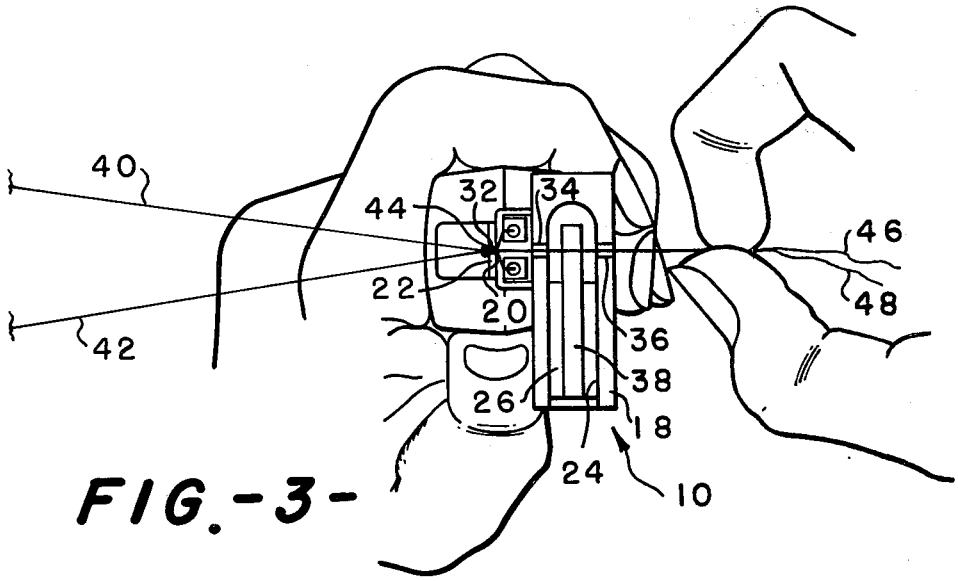
FIG.-3-
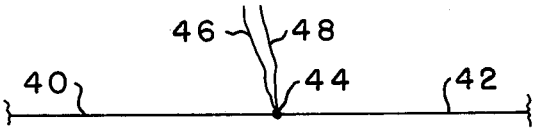
FIG.-4-
FIG.-5-
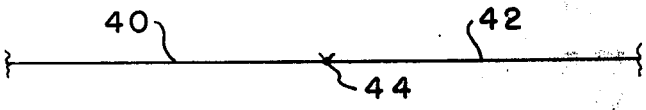
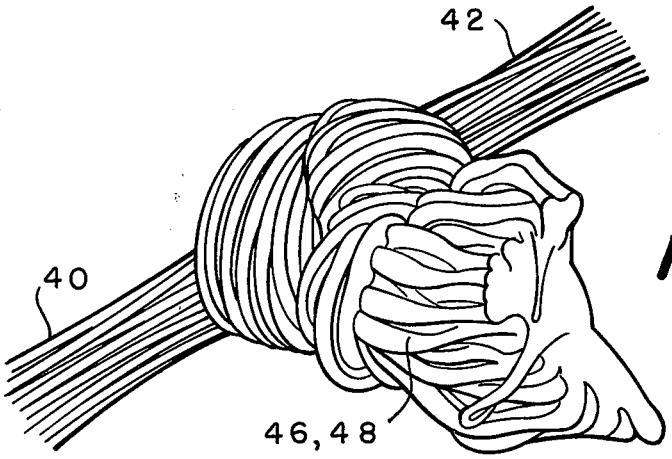
FIG.-6-

SYNTHETIC YARN DEVICE

It is an object of the invention to provide a yarn cutting device and a method of use to securely lock one yarn to another when they have been tied together.

Other objects of the invention will become readily apparent as the specification proceeds to describe the invention with reference to the accompanying drawings, in which:

FIG. 3 is a top view of FIG. 2;

FIG. 4 is a view of two tied yarns severed by the disclosed apparatus;

FIG. 5 is a view similar to FIG. 4 showing the tied yarns pulled to eliminate the yarn tails and FIG. 6 is a blow-up view of the yarn knot of FIG. 5.

Figure 1:
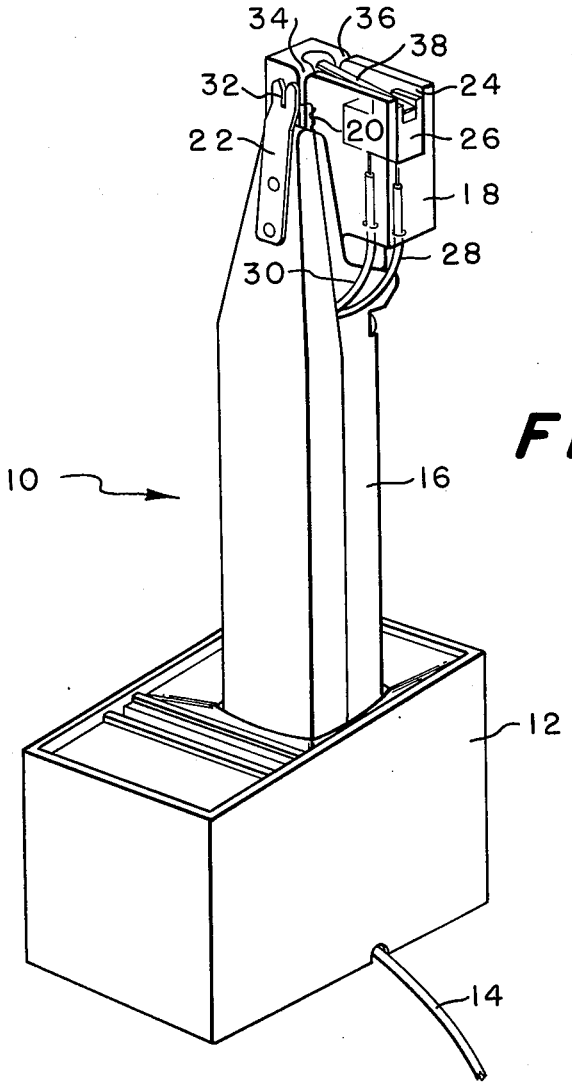
FIG. 1 is an isometric view of the new and improved apparatus.

Looking now to FIG. 1, the yarn severing device 10 is shown mounted in a battery charger 12 which can be plugged into a suitable A-C outlet through cord 14. The yarn severing device 10 is operated by a rechargeable battery 16 which can be recharged by the insertion into the battery charger 12. The battery is enclosed in a plastic housing at the top of which is mounted a plastic switch plate 18, a nichrome resistance heater 20 and a knot stop plate 22. Supported in the notch 24 of the plate 18 is a microswitch 26 connected to the battery 16 by wires 28 and 30. The heater 20 is mounted between the plate 18 and plate 22 in line with the notches 32, 34 and 36. The microswitch actuator 38 is located between the notches 34 and 36 and is moved downward to interconnect wires 28 and 30 to complete the circuit from the battery 16 to heater 20. It should be noted that the notch 36 is deeper than the notch 32 so that the yarn can be pulled downward in the slot 36 to actuate the microswitch 26.

The apparatus above described is capable for use on many types of yarn whether natural or synthetic but is particularly useful for the tying of synthetic continuous filament yarns together. In the preferred form of the invention, the head of one package of polyester yarn is being tied to the tail of another package of polyester yarn using a chicken head knot which readily slips and then locks when the tied yarn is pulled.

OPERATION

As noted above, it is desired to connect two ends of thermoplastic yarn, preferably polyester, together so that the connecting point, normally a knot, will not slip or get caught in the textile machine processing the yarn. FIGS. 5 and 6 show the yarns 40 and 42 connected by a knot 44 which will fulfill the desired function of the yarn.

Figure 2:
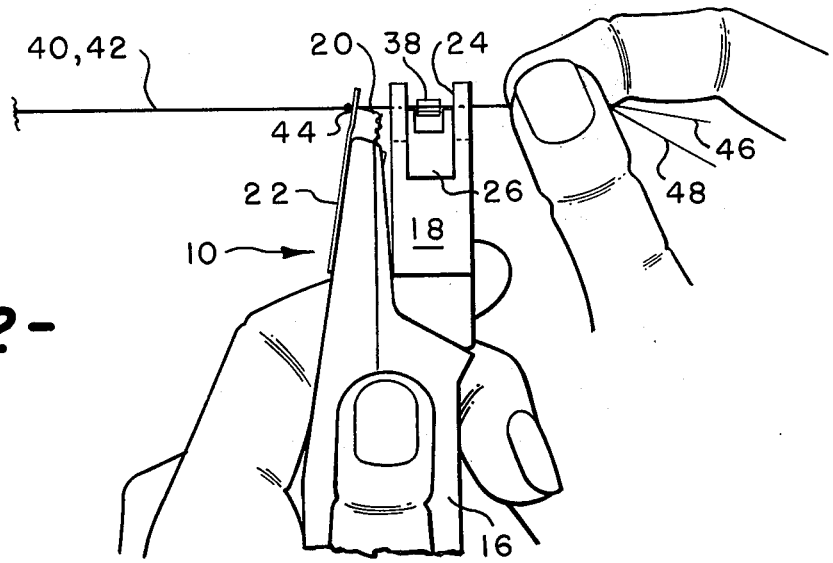
FIG. 2 is a front elevation view of the apparatus of FIG. 1 showing two tied yarns in position to be severed.

To accomplish the above two polyester yarns 40 and 42 are tied together using a chicken head knot. Then, as shown, in FIGS. 2 and 3, the tied yarns are placed in the device 10 the yarns 40 and 42 and the knot 44 on one side of the knot stop 22 with the tails 46 and 48 of the yarns 40 and 42 placed in the notches 34 and 36. Then the yarn tails 46 and 48 are pulled downwardly against the switch actuator 38 to supply energy from the battery 16 to the resistance heater 20. When the heater 20 heats up it will separate a portion of the yarn tails and swell the individual filaments of each of the yarn tails left connected to the yarns 40 and 42 as indicated in FIG. 6. The connected yarn will then be as shown in FIG. 5 so that the yarns 40 and 42 can be pulled to slip the tails 40 and 42 down towards the knot 44 until the swelled filaments thereof bind in the knot 44 as shown in FIG. 6.

The V-shaped notch 32 in the plate 22 provides a limiting factor to the position of the knot 44 when the tails 46 and 48 are pulled downwardly to actuate the heater 20. It is obvious that the longer the tail that you desire, the further to the left of the plate 22 (FIGS. 2 and 3) the knot 44 in the yarn will be placed.

It is obvious that an apparatus has been described which will produce a yarn from two tied yarns which has a minimum size knot therein which will not slip and can be readily run through a textile processing machine without slippage or entanglement.

Although we have described in detail the preferred embodiment of the invention, it is contemplated that changes may be made without departing from the scope or spirit of the invention and it is desired that the invention only be limited by the scope of the claims.

That which is claimed is:

1. An apparatus to sever the tails of two tied yarns comprising: a source of power, heater means operably associated with and mounted on said source of power, switch means mounted on said source of power in line with said heater means on one side thereof, a notched plate mounted on said source of power on the other side of said heater means in line with said switch means and a slot in said switch means in line with the notch in the notched plate to accommodate a tied yarn.

2. The apparatus of claim 1 wherein the notch in said switch means is deeper than the notch in said notched plate whereby the tied yarn can be pulled down to actuate said switch means.

* * * * *